US011361710B2

(12) United States Patent
Yin

(10) Patent No.: US 11,361,710 B2
(45) Date of Patent: Jun. 14, 2022

(54) PIXEL CIRCUIT WITH A TIME-SHARED SIGNAL LINE, A PIXEL COMPENSATION METHOD, AND A DISPLAY APPARATUS

(71) Applicant: BOE Technology Group Co., Ltd., Beijing (CN)

(72) Inventor: Xinshe Yin, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 398 days.

(21) Appl. No.: 16/486,002

(22) PCT Filed: Sep. 20, 2018

(86) PCT No.: PCT/CN2018/106726
§ 371 (c)(1),
(2) Date: Aug. 14, 2019

(87) PCT Pub. No.: WO2020/056676
PCT Pub. Date: Mar. 26, 2020

(65) Prior Publication Data
US 2022/0036818 A1 Feb. 3, 2022

(51) Int. Cl.
*G09G 3/3233* (2016.01)
*G09G 3/3266* (2016.01)
*G09G 3/3291* (2016.01)

(52) U.S. Cl.
CPC ..... *G09G 3/3233* (2013.01); *G09G 3/3266* (2013.01); *G09G 3/3291* (2013.01);
(Continued)

(58) Field of Classification Search
CPC ..... G09G 3/3233
(Continued)

(56) References Cited

U.S. PATENT DOCUMENTS

2010/0045646 A1 2/2010 Kishi
2011/0205250 A1 8/2011 Yoo et al.
(Continued)

FOREIGN PATENT DOCUMENTS

CN 102097055 A 6/2011
CN 102163402 A 8/2011
(Continued)

OTHER PUBLICATIONS

First Office Action in the Chinese Patent Application No. 201880001415.7, dated Jul. 7, 2021; English translation attached.

*Primary Examiner* — Long D Pham
(74) *Attorney, Agent, or Firm* — Intellectual Valley Law, P.C.

(57) ABSTRACT

The present application discloses a pixel circuit for one pixel in a M-row active pixel matrix of a display panel. The pixel circuit includes a data-inputting and sensing sub-circuit at least coupled to a driving transistor via a signal line and a light-emitting device associated with the pixel in one row. The data-inputting and sensing sub-circuit is configured to use the signal line as a data line for loading a data signal to the pixel in a current cycle of displaying one frame of image. The data signal is compensated based on a compensation signal detected for the pixel in one of previous M−1 numbers of cycles. The signal line is also used as a sensing fine once per cycle for detecting a sensing signal in the current cycle to generate the compensation signal for the pixel when the one row is selected from the M-row active pixel matrix.

12 Claims, 8 Drawing Sheets

(52) U.S. Cl.
CPC ..... *G09G 2310/0286* (2013.01); *G09G 2320/045* (2013.01)

(58) Field of Classification Search
USPC ..... 345/76
See application file for complete search history.

(56) References Cited

U.S. PATENT DOCUMENTS

| | | | | |
|---|---|---|---|---|
| 2013/0147694 | A1 | 6/2013 | Kim et al. | |
| 2013/0162617 | A1 | 6/2013 | Yoon et al. | |
| 2014/0176401 | A1 | 6/2014 | Kim et al. | |
| 2015/0187276 | A1 | 7/2015 | Shim et al. | |
| 2016/0203764 | A1* | 7/2016 | In | G09G 3/3233 345/215 |
| 2017/0140703 | A1* | 5/2017 | Nishikawa | G11C 19/28 |
| 2017/0287390 | A1* | 10/2017 | Lee | G09G 3/3233 |
| 2018/0322830 | A1 | 11/2018 | Xu | |
| 2019/0156747 | A1 | 5/2019 | Nie et al. | |

FOREIGN PATENT DOCUMENTS

| | | | |
|---|---|---|---|
| CN | 103165079 | A | 6/2013 |
| CN | 103177685 | A | 6/2013 |
| CN | 103886830 | A | 6/2014 |
| CN | 104751781 | A | 7/2015 |
| CN | 106328061 | A | 1/2017 |
| CN | 107025884 | A | 8/2017 |
| CN | 108399891 | A | 8/2018 |

* cited by examiner

PIXEL CIRCUIT WITH A TIME-SHARED SIGNAL LINE, A PIXEL COMPENSATION METHOD, AND A DISPLAY APPARATUS

CROSS-REFERENCE TO RELATED APPLICATION

This application is a national stage application under 35 U.S.C. § 371 of International Application No. PCT/CN2018/106726, filed Sep. 20, 2018, the contents of which are incorporated by reference in the entirety.

TECHNICAL FIELD

The present invention relates to display technology, more particularly, to a pixel circuit with external compensation via a shared signal line, a pixel compensation method, and a display apparatus.

BACKGROUND

Light emission of a pixel in an organic light-emitting diode (OLED) based display panel is driven by a drive current from a driving voltage source coupled to a driving transistor in series and controlled by a gate voltage from a data signal that provides pixel grayscales. Typical 2T1C pixel circuit generates the drive current depended on a threshold voltage $V_{th}$ of the driving transistor and a source voltage of the driving transistor. Any drift of the $V_{th}$ from one pixel to another causes difference in light emission of corresponding pixels, leading to poor image quality. Some approaches using an internal compensation scheme have been proposed for compensating the drift of the threshold voltages of the driving transistors in the display panel to achieve better display quality. Still, improved design on pixel circuit and driving method with less number of control signal lines and more complete compensation of drifts of circuit electrical parameters are desired.

SUMMARY

In an aspect, the present disclosure provides a pixel circuit for one pixel in a M-row active pixel matrix of a display panel. The pixel circuit includes a driving sub-circuit respectively coupled to a first power supply, a first node, a second node, and configured to drive a light-emitting device of a pixel in an m-th row of pixels of the M-row active pixel matrix. $1 \leq m \leq M$. Additionally, the pixel circuit includes a data-inputting and sensing sub-circuit respectively coupled to the first node, the second node, a reference voltage terminal, a scan line associated with the pixel in the m-th row of pixels, a signal line, and the light-emitting device associated with the pixel. The data-inputting and sensing sub-circuit is configured, when the m-th row of pixels is a selected row for sensing in a current cycle of displaying one frame of image, to use the signal line as a sensing line in a sensing period for detecting a sensing signal to generate a compensation signal for the pixel, and use the signal line as a data line in a data-input and compensation period for loading a data signal compensated based on the compensation signal for the pixel.

Optionally, the data-inputting and sensing sub-circuit is further configured, when the m-th row of pixels is other than the selected row for sensing in the current cycle, to use the signal line as a data line in a data-input and compensation period for loading a data signal, compensated based on a compensation signal generated for the pixel in the m-th row of pixels in an earlier cycle in which the m-th row of pixel was the selected row.

Optionally, the driving sub-circuit includes a driving transistor having a drain electrode coupled to the first power supply, a gate electrode coupled to the first node, and a source electrode coupled to the second node. The data-inputting and sensing sub-circuit includes a second transistor having a source electrode coupled to the second node, a gate electrode coupled to the scan line, and a drain electrode coupled to the anode of the light-emitting device Which has a cathode coupled to a second power supply. The data-inputting and sensing sub-circuit further includes a third transistor having a chain electrode coupled to the signal line, a gate electrode coupled to the scan line, and a source electrode coupled to the second node. Additionally, the data-inputting and sensing sub-circuit includes a fourth transistor having a drain electrode coupled to the reference voltage terminal, a gate electrode coupled to the scan line, and a source electrode coupled to the first node. Furthermore, the data-inputting and sensing sub-circuit includes a storage capacitor having a first electrode coupled to the first node and a second electrode coupled to the second node.

Optionally, the first power supply provides a fixed high voltage. The second power supply provides a fixed low voltage. The second transistor is a p-type transistor. Each of the driving transistor, the third transistor, and the fourth transistor is an n-type transistor. The light-emitting device is an organic light-emitting diode.

Optionally, each cycle includes M−1 numbers of normal scans and one sensing scan. Each of the M−1 numbers of normal scans corresponds to applying an effective gate-driving signal to the scan line associated with the m-th row of pixel out of M−1 numbers of rows other than the selected row for sensing to load the data signal to the signal line served as the data line during the data-input and compensation period to set voltage and further to the source electrode of the driving transistor, and to set a reference voltage from the reference voltage terminal to the gate electrode of the driving transistor, thereby determining a drive current to drive light emission of the light-emitting device of the pixel of the m-th row of pixels in remaining time of the current cycle, wherein the data signal is compensated from an original data voltage provided for the pixel in the current cycle by subtracting a threshold voltage of the driving transistor carried in the sensing signal detected in one of earlier M−1 numbers of cycles.

Optionally, the one sensing scan corresponds to the sensing period added before the data-input and compensation period for the m-th row of pixels being selected for sensing in the current cycle. The sensing period includes a resetting sub-period, an establishing sub-period, and a sampling sub-period. The one sensing scan is K times longer than each normal scan. K is a number up to a few tens.

Optionally, the pixel circuit further is coupled to a bias circuit including a fifth transistor having a drain electrode coupled to an initializing voltage terminal, a gate electrode coupled to a reset terminal, and a source electrode coupled to the signal line. The reset terminal provides an effective reset signal in the resetting sub-period to set an initializing voltage from the initializing voltage terminal to a parasitic capacitor associated with the signal line and to the source electrode of the driving transistor via the second node. The initializing voltage is set to be smaller than a first voltage equal to the reference voltage minus a threshold voltage of the driving transistor.

Optionally, the source electrode of the driving transistor is gradually charged to the first voltage in the establishing sub-period which is made long enough in the one sensing scan to allow the first voltage to be fully stored in the parasitic capacitor of the signal line.

Optionally, the signal line is served as the sensing line from which the first voltage stored in the parasitic capacitor of the signal line is read as the sensing signal in the sampling sub-period and sent to an external compensation module for deducing the threshold voltage of the driving transistor as the compensation signal and generating a compensated data signal for the pixel. The compensated data signal is a difference between the original data voltage and the threshold voltage.

Optionally, the signal line is served as the data line to send the compensated data signal for the pixel back to the data line in the data-input and compensation period following the sensing period and to store a second voltage in the storage capacitor, the second voltage being the reference voltage minus the compensated data signal and for generating a drive current to drive light emission of the light-emitting device of the pixel beyond the data-input and compensation period in remaining time of the current cycle.

Optionally, the compensated data signal for the pixel in the selected row for sensing is further compensated with an extra compensation signal increased by a $(K-1)/M \cdot 100\%$ for a loss of light emission during the sensing period before being loaded to the data line in the data-input and compensation period following the sensing period in one sensing scan in the current cycle. The compensated data signal for the pixel in any one row other than the selected row for sensing is configured to be loaded to the data line without the extra compensation signal in the data-input and compensation period in one normal scan without the sensing period in each of next M−1 numbers of cycles.

Optionally, the one sensing scan is associated with one row selected from the M-row active pixel matrix per cycle, which is rotated from a first row (m=1) in a first cycle to a last row (m=M) M-th cycle in M numbers of cycles.

In another aspect, the present disclosure provides display apparatus including a display panel having M-row active pixel matrix, a pixel circuit described herein and disposed in each pixel including a light-emitting device, a bias circuit coupled to a signal line, a driver IC connected to the pixel circuit via the signal line, and a controller including a compensation module coupled to the driver IC via a communication interface. The signal line in a sensing scan of a current cycle of displaying one frame of image is served as a sensing line used to detect local electrical parameters of the pixel and send a sensing signal carrying the local electrical parameters to a compensation module in the controller. The signal line is alternatively served as a data line used to load a data signal compensated by the compensation module based on the local electrical parameters back to the pixel.

Optionally, each row of pixels in the M-row active pixel matrix is associated with at least a scan line for supplying a scan signal having a pulse width of one unit scan time for a normal scan or an extended pulse width of K units scan time for the sensing scan. K is a number up to a few tens.

Optionally, the M-row active pixel matrix is scanned progressively one row after another in each cycle of displaying one frame of image. The sensing scan is performed for just one row of pixels selected for sensing and the normal scan is performed for every one row out of remaining M−1 numbers of rows other than the selected row for sensing in the M-row active pixel matrix. A blanking time having at least (K−1) units scan time is provided from one cycle to a next cycle.

Optionally, the one row selected for sensing is selected once per cycle by rotating among M numbers of rows of the M-row active pixel matrix sequentially M numbers of cycles.

In yet another aspect, the present disclosure provides a method for driving a display panel with a M-row active pixel matrix in one cycle of displaying one frame of image. The method includes scanning a control signal to one row after another of M rows of pixels in the M-row active pixel matrix to set a reference voltage to a gate voltage of a driving transistor in a pixel circuit associated with a pixel in an m-th row, $1 \leq m \leq M$. The method further includes using a signal line connected to the pixel circuit as a sensing line if the m-th row is selected to be a sensing row in a current cycle. Additionally, the method includes reading a sensing signal from the sensing line for determining a compensated data signal in a sensing period in an extended scan time in the current cycle. The method further includes making the signal line as a data line in a data-input and compensation period following the sensing period, Furthermore, the method includes loading the compensated data signal via the data line in the data-input and compensation period to set a source voltage of the driving transistor in the pixel associated with the pixel in the sensing row. Moreover, the method includes loading a data signal via the signal line served as the data line to set a source voltage of the driving transistor in the pixel circuit if the m-th row belongs to other M−1 numbers of rows other than the sensing row in a data-input and compensation period in a normal scan time without a sensing period in the current cycle. The data signal is compensated based on another sensing signal read in one of earlier M−1 numbers of cycles.

Optionally, the normal scan time includes one unit of time and the extended scan time comprises K times of the unit of time, wherein K is up to a few tens.

Optionally, the step of reading the sensing signal includes resetting the sensing line to an initializing voltage firstly in a resetting sub-period of the sensing period. The initializing voltage is set to be smaller than a first voltage equal to the reference voltage minus a threshold voltage of the driving transistor. The step of reading the sensing signal also includes charging the sensing line to reach the first voltage in an establishing sub-period of the sensing period by making K sufficiently large in the extended scan time. The step of reading the sensing signal also includes sending the first voltage to an external compensation module in a sampling sub-period of the sensing period for generating the compensation data signal equal to an original data signal minus the threshold voltage of the driving transistor.

Optionally, the step of loading the compensated data signal includes sending the compensated data signal with an extra compensation to cover a loss of emission time during the sensing period beyond a compensation of the threshold voltage of the driving transistor from the external compensation module to the pixel circuit associated with the pixel in the one row selected as the sensing row in the current one cycle. The step of loading the compensated data signal thriller includes sending the compensated data signal with the compensation of the threshold voltage of the driving transistor from the external compensation module to the data line of the pixel circuit to set the source voltage of the driving transistor in the pixel circuit associated with a same pixel in a same m-th row but other than the sensing row in each one of next M−1 numbers of cycles.

BRIEF DESCRIPTION OF THE FIGURES

The following drawings are merely examples for illustrative purposes according to various disclosed embodiments and are not intended to limit the scope of the present invention.

DETAILED DESCRIPTION

The disclosure will now be described more specifically with reference to the following embodiments. It is to be noted that the following descriptions of some embodiments are presented herein for purpose of illustration and description only. It is not intended to be exhaustive or to be limited to the precise form disclosed.

Although many approaches have been provided on pixel circuit design with variously compensation scheme for generating a drive current that is substantially independent of the threshold voltage of driving transistor in the proposed pixel circuits, yet these circuit design either is still too complicated with too many transistors build-up therein or needs too many control signal lines to operate, limiting its ability to minimize pixel size for high resolution display panel. Accordingly, the present disclosure provides, inter cilia, a pixel circuit with time-shared signal line, a driving method with improved external compensation scheme, and a display apparatus having the same that substantially obviate one or more of the problems due to limitations and disadvantages of the related art.

Figure 1:
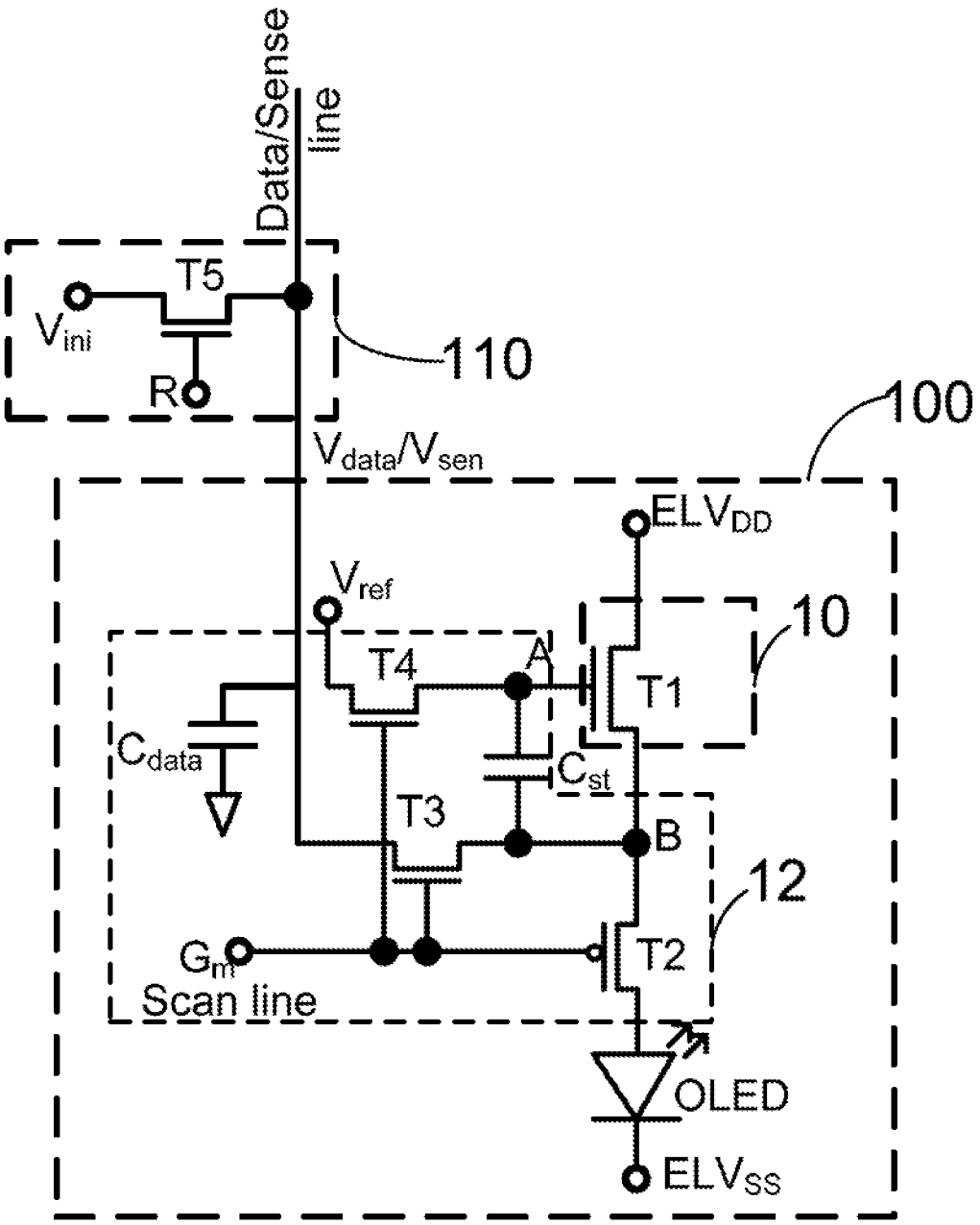
FIG. 1 is a circuit diagram of a 4T1C structure having a time-shared signal line coupled externally to a bias circuit and a driver IC according to some embodiments of the present disclosure.

In one aspect, the present disclosure provides a pixel circuit that has a simplified circuitry design for driving light emission of a light-emitting device associated with a pixel in a M-row active pixel matrix of display panel. The display panel optionally includes an active area made by M×N pixel matrix. Optionally, light-emitting device associated with each pixel uses an organic light-emitting diode (OLED) to produce light for generating a pixel image. Optionally, the display panel is an OLED display panel with high resolution, for example, M=2560 rows of pixels in a vertical format QHD display panel. Each pixel includes a pixel circuit. FIG. 1 is a circuit diagram of a 4T1C structure having a time-shared signal line coupled externally to a bias circuit and a driver IC according to some embodiments of the present disclosure. In an embodiment, the pixel circuit 100 includes a driving sub-circuit 10 respectively coupled to a first power supply $ELV_{DD}$, a first node A, a second node B, and configured to drive a light-emitting diode (LED) of a pixel in an m-th row of pixels of the M=row active pixel matrix. $1 \leq m \leq M$. Additionally, the pixel circuit 100 includes a data-inputting and sensing sub-circuit 12 respectively coupled to the first node A, the second node B, a reference voltage terminal $V_{ref}$, a scan line associated with the pixel in the m-th row of pixels, a signal line, and the LED associated with the pixel. In an embodiment, the data-inputting and sensing sub-circuit 12 is configured, when the m-th row of pixels is a selected row for sensing in a current cycle of displaying one frame of image, to use the signal line as a sensing line in a sensing period for detecting a sensing signal to generate a compensation signal for the pixel and to use the signal line as a data line in a data-input and compensation period for loading a data signal compensated based on the compensation signal for the pixel.

In a specific embodiment, referring to FIG. 1, the pixel circuit 100 includes four transistors T1, T2, T3, and T4 and a capacitor Cst, coupled to a light-emitting diode. Optionally, the driving sub-circuit 10 includes a driving transistor coupled to the light-emitting device. Optionally, the first transistor T1 is the driving transistor configured to provide a stable drive current for the LED. Optionally, the data-inputting and sensing sub-circuit 12 includes three switch transistors and a capacitor. The driving transistor T1 has a drain electrode coupled to a first (high) power supply $ELV_{DD}$, a gate electrode coupled to a first node A, and a source electrode coupled to a second node B. In the embodiment, the driving transistor T1 is in a serial connection from the first power supply $ELV_{DD}$ via the second transistor T2, a switch transistor, to the light-emitting device. In particularly, a source electrode of the driving transistor T1 and a source electrode of the switch transistor T2 is commonly connected to the second node B, the switch transistor T2 then has its drain electrode coupled to an anode of the LED, which is optionally an organic light-emitting diode (OLED). The OLED further has its cathode connected to a (low) power supply $ELV_{SS}$ so that the serial connection can be utilized by the driving transistor T1 to determine the stable drive current and controlled by the switch transistor T2 in a certain timing scheme for driving the OLED to emit light.

Referring to FIG. 1, the switch transistor T2 has its gate electrode being connected to a scan line configured to receive a scan signal $G_m$ to control On or Off of the switch transistor T2 for controlling light emission of the pixel. Optionally, the scan line is for providing the scan signal $G_m$, which is a gate-driving signal outputted from a gate-on-array (GOA) driving circuit (which is a peripheral circuit not shown in FIG. 1) for a whole row (e.g., m-th row) of pixels in the M-row active pixel matrix.

Referring to FIG. 1, the third transistor T3 in the pixel circuit 100 is another switch transistor, having its gate electrode coupled also to the scan line, its drain electrode coupled to a signal line, and its source electrode coupled to the second node B. This switch transistor T3 is used to control loading a data signal via the signal line, which is served as a data line to receive the data signal from an external controller (not shown in FIG. 1), to the second node for setting a voltage level at the second node B. The second node B is also the source electrode of the driving transistor T1. Setting the voltage level of the source electrode is required to set the state of the driving transistor T1 for determining the drive current. In an alternate time, the same signal line can be used as a sensing line when the pixel (or the row of pixels associated with a same scan line) is selected for detecting electrical parameters of the pixel, the third transistor T3 is used to control transferring a sensing signal carrying a voltage stored in a parasitic capacitor $C_{data}$ thereof to a compensation module in the external controller. Optionally, both the second transistor T2 and the third transistor T3 are controlled by the scan signal $G_m$. Optionally, the second transistor T2 is a PMOS transistor and the third transistor T3 is a NMOS transistor. When the third transistor T3 is controlled to be an On state by the scan signal $G_m$, at the same time the second transistor T2 is controlled to be an Off state by the same scan signal $G_m$.

Additionally, the fourth transistor T4 in the pixel circuit 100 is yet another switch transistor, having its gate electrode also coupled to the scan line, its drain electrode coupled to a reference voltage terminal, and its source electrode coupled to the first node A. This switch transistor T4 is used for setting the gate electrode of the driving transistor at a fixed reference voltage $V_{ref}$ provided to the reference voltage terminal. In the embodiment, setting the gate electrode of the driving transistor T1 to the fixed reference voltage $V_{ref}$ is required to set the state of the driving transistor T1 for determining the drive current. Furthermore, the capacitor Cst in the pixel circuit 100 is coupled between the first node A and the second node B for stabilizing the voltage levels at the first node as well as at the second node for determining a stable drive current during a saturation state of the driving transistor T1. Optionally, the fourth transistor T4 is also a NMOS transistor.

In an embodiment, the pixel circuit 100 is also coupled via the signal line to a bias circuit 110. The bias circuit 110 is part of the peripheral circuit of the display panel. As shown, the bias circuit 110 includes a fifth transistor T5 having a drain electrode coupled to an initializing voltage terminal, a source electrode coupled to the signal line, and a gate electrode coupled to a reset terminal. The initializing voltage terminal provides an initializing voltage $V_{ini}$. The reset terminal provides a reset signal R for controlling the bias circuit to reset voltage level in the signal line especially when the signal line is selected to be the sensing line. Optionally, the signal line is further connected to the external controller (not shown in FIG. 1).

Figure 2:
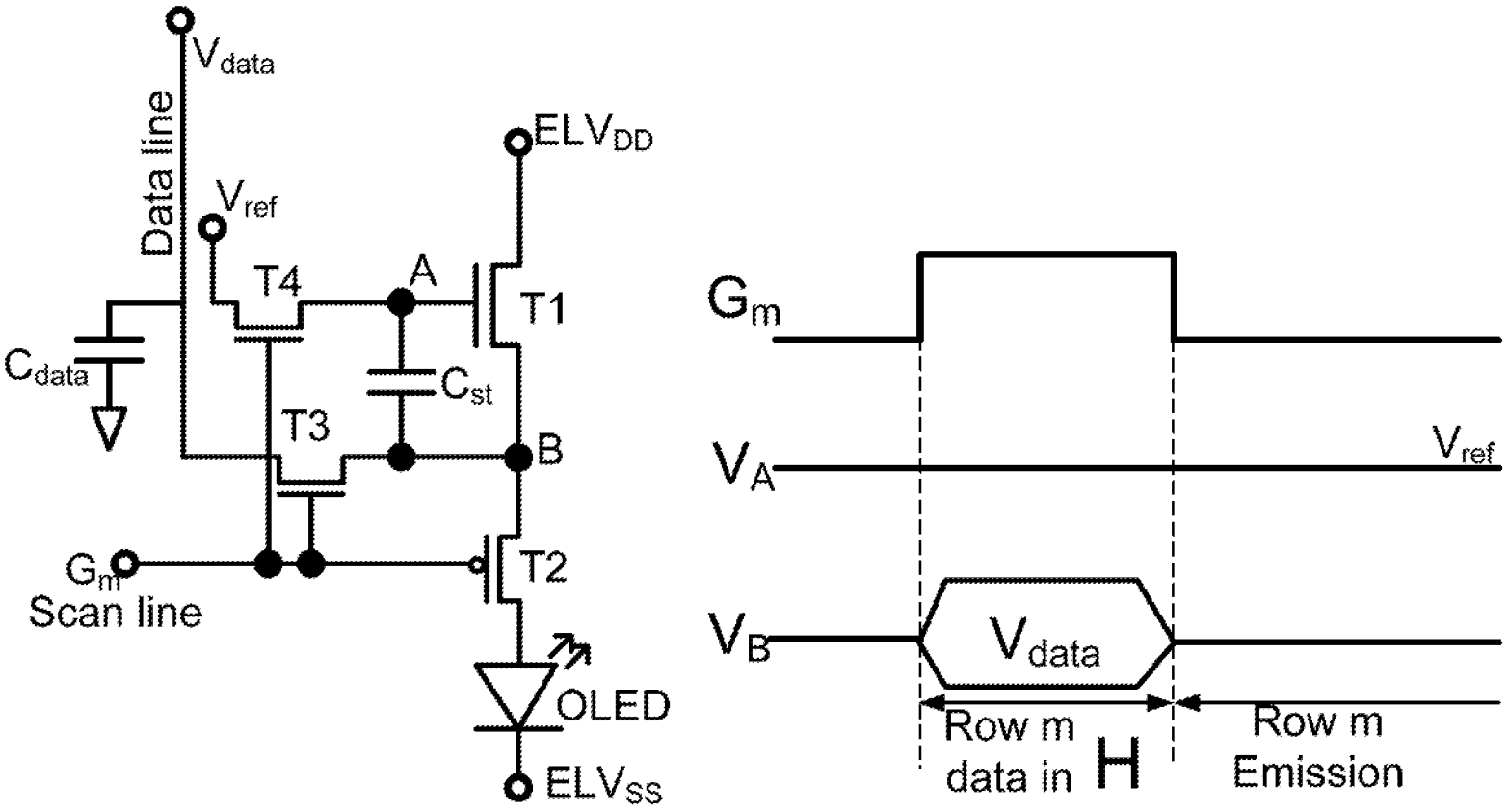
FIG. 2 is the pixel circuit and corresponding signal timing waveform in a data-input and compensation period in a normal scan according to an embodiment of the present disclosure.

FIG. 2 is the pixel circuit and corresponding signal timing waveform in a data-input and compensation period in a normal scan according to an embodiment of the present disclosure. Referring to FIG. 2, it describes a normal scan is performed to the pixel in an m-th row of pixels by providing a scan signal $G_m$ to the scan line of the pixel circuit. Optionally, the scan signal is a voltage pulse with a pulse height at a turn-on voltage (a high voltage) for NMOS transistor and a pulse width being one unit scan time H in a data-input and compensation period (as a part of the normal scan). For the display panel with M-row active pixel matrix, H is 1/M of a cycle time for scanning before a vertical blanking time added between two neighboring cycles. In this normal scan, the signal line is served as a data line to load an image data signal in a form of an analog voltage $V_{data}$ from the external controller. Since T3 and T4 are turned on and T2 (PMOS transistor) is turned off by the scan signal $G_m$ at a high voltage level during a data-input and compensation period, the second node B is set to a voltage of $V_{data}$ from the data line and the first node A is set to a voltage of $V_{ref}$ from the reference voltage terminal. The capacitor Cst thus stores a voltage $V_{ref}-V_{data}$ during this data-input and compensation period. Following the data-input and compensation period, it enters a pixel emission period of the normal scan. The scan signal Gm turns to a low voltage (or a turn-off voltage for NMOS transistor) in the emission period so that T3 and T4 are turned off to close the voltage setting of the pixel circuit but T2 is turned on to open up the serial connection for the drive current flowing from T1 to OLED. Since the voltage $V_{ref}-V_{data}$ stored in the capacitor Cst actually is the gate-to-source voltage $V_{gs}$ of the driving transistor T1, the drive current is expressed as $$I_D=\tfrac{1}{2}\mu C_{OX}(W/L)(V_{gs}-V_{th})^2,$$

where μ is a carrier mobility constant, $C_{OX}$ is capacitance associated with oxide layer in the driving transistor T1, W and L are respective width and length of the driving transistor T1.

In an embodiment, the data signal loaded from the data line has been preprocessed by the external controller, which receives original data signal from a video source and also stores a compensation signal $V_{comp}$ generated in a compensation module based on electrical parameters of the pixel circuit detected in a sensing period in one of earlier cycles for operating the same display panel. In this embodiment, the compensation signal $V_{comp}$ is just the threshold voltage $V_{th}$ of the driving transistor detected in the one of the earlier cycles. Therefore, the voltage loaded from the data line to the second node B in the current cycle is actually a compensated data signal $V_{data'}=V_{data}-V_{comp}=V_{data}-V_{th}$. The gate-to-source voltage $V_{gs}=V_{ref}-V_{data'}=V_{ref}-V_{data}+V_{th}$. Then, the drive current is $$I_D=\tfrac{1}{2}\mu C_{OX}(W/L)(V_{gs}-V_{th})^2=\tfrac{1}{2}\mu C_{OX}(W/L)(V_{ref}-V_{data})^2.$$

It is shown that the drive current $I_D$ is theoretically independent of the threshold voltage $V_{th}$. For a display apparatus, if refreshing rate and panel resolution are fixed, the scan time for each row of pixels is also fixed. For lowest resolution HID display panel with 60 Hz refreshing rate, scan time for one row is about 14.8 μs. In this short time period, the voltage setting (to the source electrode and the gate electrode) of the driving transistor T1 only is able to charge to ~70% of its saturate state. In other words, the threshold voltage value detected in the sensing period in one of earlier cycles may not be reflected a true value of $V_{th}$ for this driving transistor unless the sensing period is extended sufficiently long to truly establish the $V_{th}$ stored in a parasitic capacitor associated with the signal line.

Figure 3:
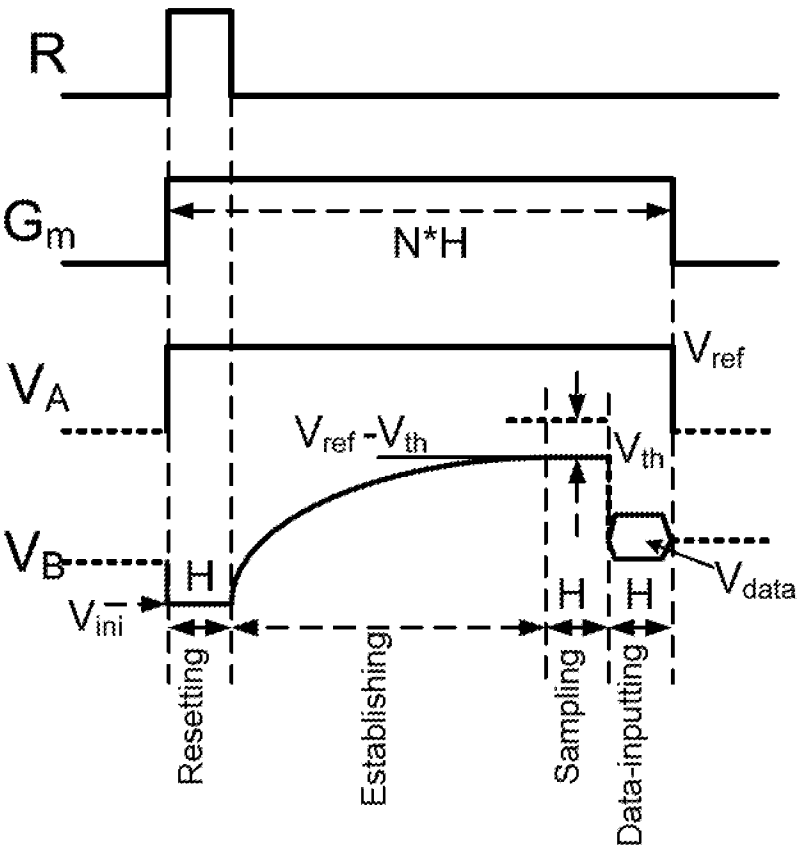
FIG. 3 is the pixel circuit coupled with the bias circuit and corresponding signal timing waveform in a sensing period followed by a data-input and compensation period in a sensing scan according to an embodiment of the present disclosure.
Figure 3:
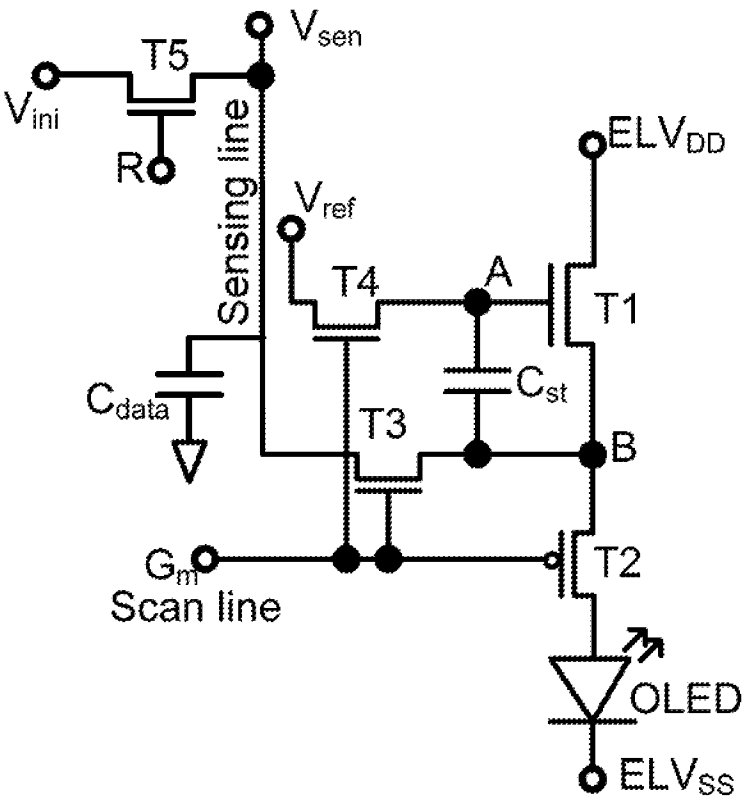

FIG. 3 is the pixel circuit coupled with the bias circuit and corresponding signal timing waveform in a sensing period followed by a data-input and compensation period in a sensing scan according to an embodiment of the present disclosure. Referring to FIG. 3 it describes a sensing scan is performed to the pixel in an m-th row of pixels, which is one selected from the M-row active pixel matrix of the display panel in the current cycle of displaying one frame of image, by providing a scan signal $G_m$ with an extended pulse width to the scan line of the pixel circuit 100 of FIG. 1. The pixel circuit 100 of FIG. 1 is coupled via the signal line, served as a sensing line, with a bias circuit 110 of FIG. 1. As seen in the timing diagram, the sensing scan starts with a resetting sub-period in which a reset signal R is provided to the reset terminal of the bias circuit 110. Both the scan signal $G_m$ and the reset signal R are provided with a high voltage (turn-on voltage for NMOS transistor) to turn on NMOS switch transistors T3, T4, and T5 but to turn off TWOS switch transistor 12. No drive current exists through the serial connection from high voltage supply EL $V_{DD}$ via the driving transistor T1 and switch transistor T2 to the OLED. No light is emitted from the OLED. The fifth transistor T5 is turned on to allow the initializing voltage $V_{ini}$ to charge parasitic capacitor $C_{data}$, of the sensing line as well as the second node B of the storage capacitor Cst, making the voltage level at the source electrode of the driving transistor T1 to be $V_{ini}$. Optionally, the resetting sub-period can be fairly short, for example, up to just one unit scan time H.

Figure 4:
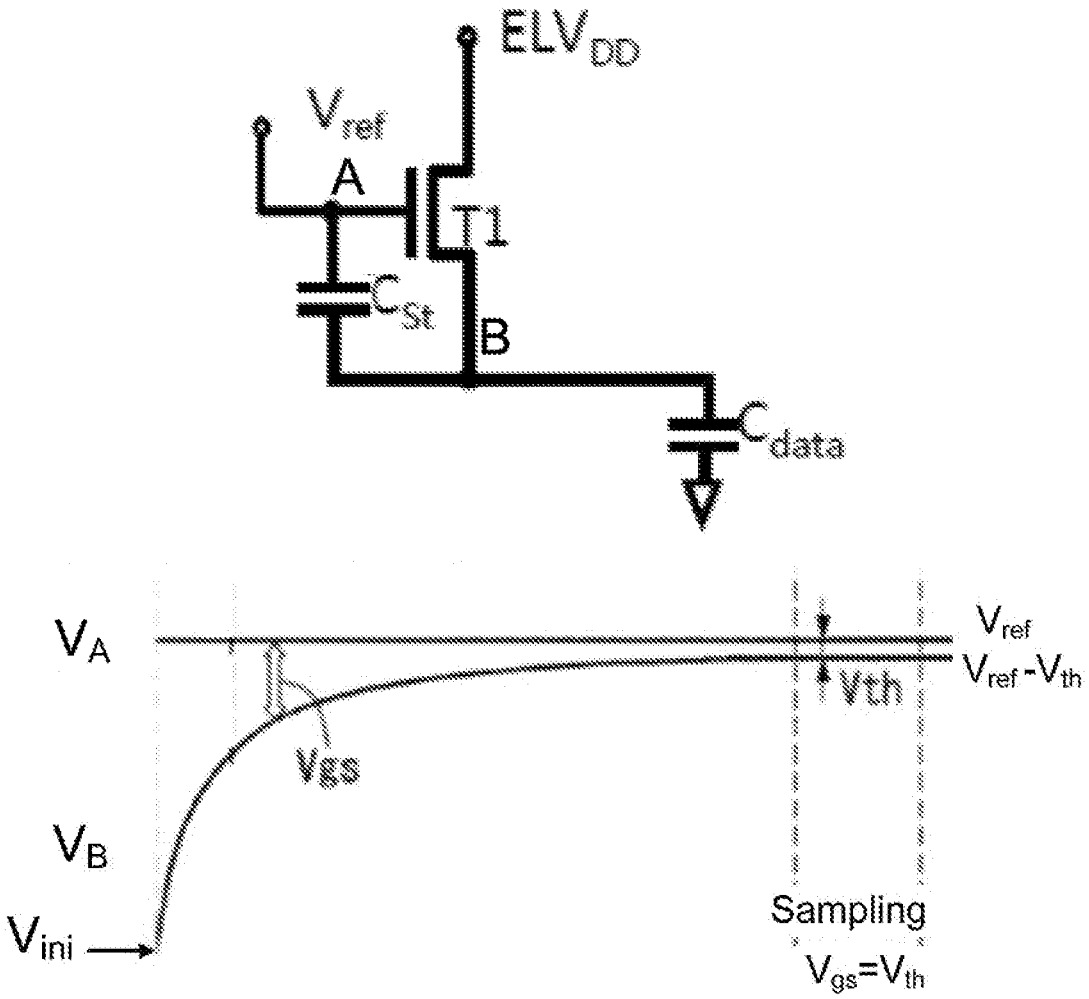
FIG. 4 is an effective circuit of the pixel circuit operated in an establishing sub-period and sampling sub-period within the sensing period according to an embodiment of the present disclosure.

Further, following, the resetting sub-period (see FIG. 3 and FIG. 4), it is an establishing sub-period in which the reset signal R is off to turn the fifth transistor T5 off but the scan signal $G_m$ is still a high voltage to keep the third transistor T3 and the fourth transistor T4 on. The gate electrode (or the first node) of the driving transistor T1 is set to the fixed reference voltage $V_{ref}$, i.e., $V_A=V_{ref}$. The source electrode (or the second node B) of the driving transistor T1 has a same voltage level $V_B$ as that in the sensing line which is initialized to $V_{ini}$ at the end of the resetting sub-period. In an embodiment, the initializing voltage $V_{ini}$ is set to be smaller than a difference of the reference voltage $V_{ref}$ and the threshold voltage $V_{th}$. FIG. 4 shows an equivalent circuit of the pixel circuit during the establishing sub-period. The driving transistor T1 is enabled by the gate-to-source voltage $V_{gs}=V_A-V_B=V_{ref}-V_{ini}>V_{th}$ to allow a conduction current $I_{ds}$ flowing from the high voltage supply $ELV_{DD}$ to the source electrode (the second node B), gradually pushing up the voltage level of $V_B$ higher (letting $V_{gs}$ lower and $I_{ds}$ lower) till it reaches a level of $V_{ref}-V_{th}$ (the driving transistor T1 is off by then). The establishing sub-period is set intentionally to be long enough to allow charging through the driving transistor T1 to the second node B or essentially into the parasitic capacitor Cdata to be sufficiently completed at the level of $V_{ref}-V_{th}$.

Immediately following the establishing sub-period, a sampling sub-period (see FIG. 3 and FIG. 4) is included to allow the voltage $V_{sen}=V_{ref}-V_{th}$ charged into the sensing line to be read as a sensing signal by an external compensation module (in the external controller). Optionally, a driver integrated circuit (drive IC) is used to sense the $V_{sen}$ and converted the analog voltage to a digital voltage sent to the external compensation module. Since reference voltage $V_{ref}$ is a fixed voltage, the threshold voltage $V_{th}$ can be easily deduced from the $V_{sen}$ as the compensation signal $V_{comp}=V_{th}$ being stored in the compensation module. Optionally, it takes no more than one unit scan time H to accomplish reading the sensing signal to deduce the compensation signal or the threshold voltage of the driving transistor.

Referring to FIG. 3, after the sampling sub-period a data-input and compensation period can be performed in the sensing scan. Like a normal scan, the data-input and compensation period is to write a new data signal through the signal line, which is served as a data line again, into the source electrode of the driving transistor T1. And, the new data signal is a compensated data signal $V_{data'}$. As the compensation signal $V_{comp}$ is just deduced by the compensation module in the sampling sub-period, the compensation module further can quickly perform a compensation algorithm to convert an incoming original data signal to the compensated data signal $V_{data'}$ based on the latest deduced compensation signal $V_{comp}$ which is just the threshold voltage $V_{th}$ of the driving transistor T1 at the last sampling sub-period. Optionally, the compensated data signal $V_{data'}$ is obtained by subtracting the compensation signal $V_{comp}=V_{th}$ from an analog voltage $V_{data}$ representing the incoming original data signal, i.e., $V_{data'}=V_{data}-V_{th}$. Using the signal line as the data line in the data-input and compensation period, the compensated data signal $V_{data'}$ is sent from the external compensation module via the driver IC to the data line of the pixel circuit. Optionally, if the compensation module can perform the compensation algorithm quick enough this data-input and compensation period is no different from any one performed in normal scan over a row that is not selected for sensing. Thus the data-input and compensation period takes no more than one unit scan time H to accomplish the loading of $V_{data'}$ back to the data line. In the data-input and compensation period, the gate-to-source voltage of the driving transistor T1 is set to $V_{gs}=V_{ref}-V_{data'}$. No light emission is allowed yet in this data-input and compensation period as the second transistor T2 (PMOS transistor) is still off. In other words, the pixel does not emit light during the whole sensing period and data-input and compensation period. Next in a pixel emission period (which is remaining time of the cycle after the scan signal Gm scans any row of the M-row active pixel matrix), the pixel in the row of pixels is configured to produce light emission based on this $V_{gs}$.

Optionally, the m-th row of pixels with which the pixel is associated to deduce the threshold voltage $V_{th}$ of the driving transistor is only selected once in each cycle. The threshold voltage $V_{th}$ of the driving transistor of the pixel is stored in the compensation module and reused to deduce the compensation data signal in next M−1 numbers of cycles when the same m-th row of pixels is scanned in a normal scan without any sensing period. Additionally, for the m-th row of pixels that is selected for sensing in a current cycle, the sensing period with extended scan time is added in front of the data-input and compensation period, the effective emission time of the pixel in the m-th row is shorter than that of the pixel in other rows other than the sensing row. Therefore, the compensated data signal $V_{data'}$ needs an extra compensation to cover a loss of light emission during the sensing period on top of general compensation related to the threshold voltage of the driving transistor. More details are given below on operating a display panel with M-row active pixel matrix with one row of pixels being selected for sensing once in each cycle of displaying one frame of image.

Figure 5:
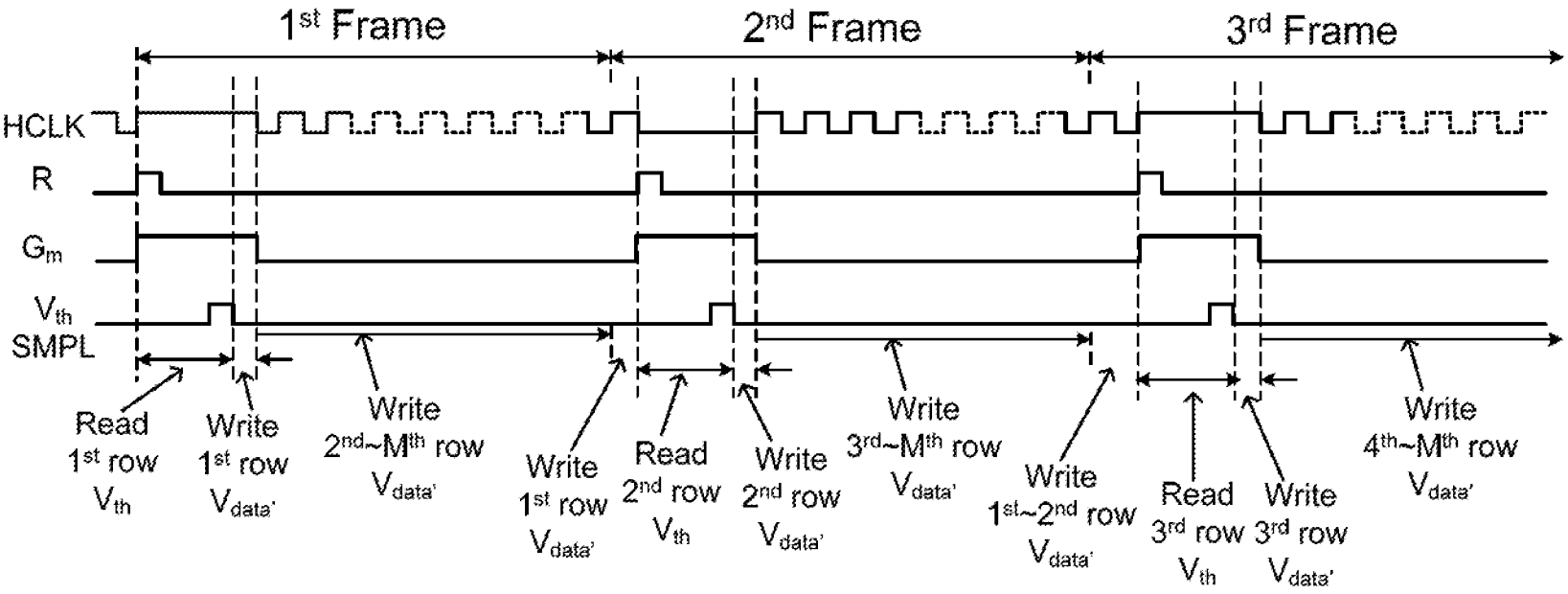
FIG. 5 is a schematic timing diagram showing an example with three consecutive frames being scanned according to an embodiment of the present disclosure.

FIG. 5 is a schematic timing diagram showing an example with three consecutive frames being scanned according to an embodiment of the present disclosure. Referring to FIG. 5, the timing diagram is an example of a method for operating a display panel to display image one frame after another. First of all, the operation of the display panel with multiple rows of pixels is conducted by scanning progressively one row after another. Specifically, the scanning is driven by a clock signal HLCK (generated by the controller) having typical regular pulse width of one unit scan time in each cycle of displaying one frame of image except that one pulse is supplied with an extended width of K units scan time in the cycle. Here K is a number up to a few tens. This clock signal HCLK can be used together with other corresponding control signals or voltage signals generated by the controller to drive a gate-driver-on-array (GOA) circuit to generate the scan signal Gm. The scan signal Gm can be configured, substantially following the clock signal HCLK in the cycle, to have an effective turn-on voltage pulse with a width of one unit scan time for every normal scan except one prolonged turn-on voltage with a pulse width of K units scan time for one sensing scan. $V_{th}$ SMPL is a control signal given at a high voltage for the controller to control an analog-to-digital convertor (not shown) for reading the threshold voltage $V_{th}$ from the signal line of the pixel circuit of one row in one sensing scan per frame. For example, in the first frame, the $V_{th}$ associated with the first row is read. In the second frame, the $V_{th}$ associated with the second row is read.

Figure 6:
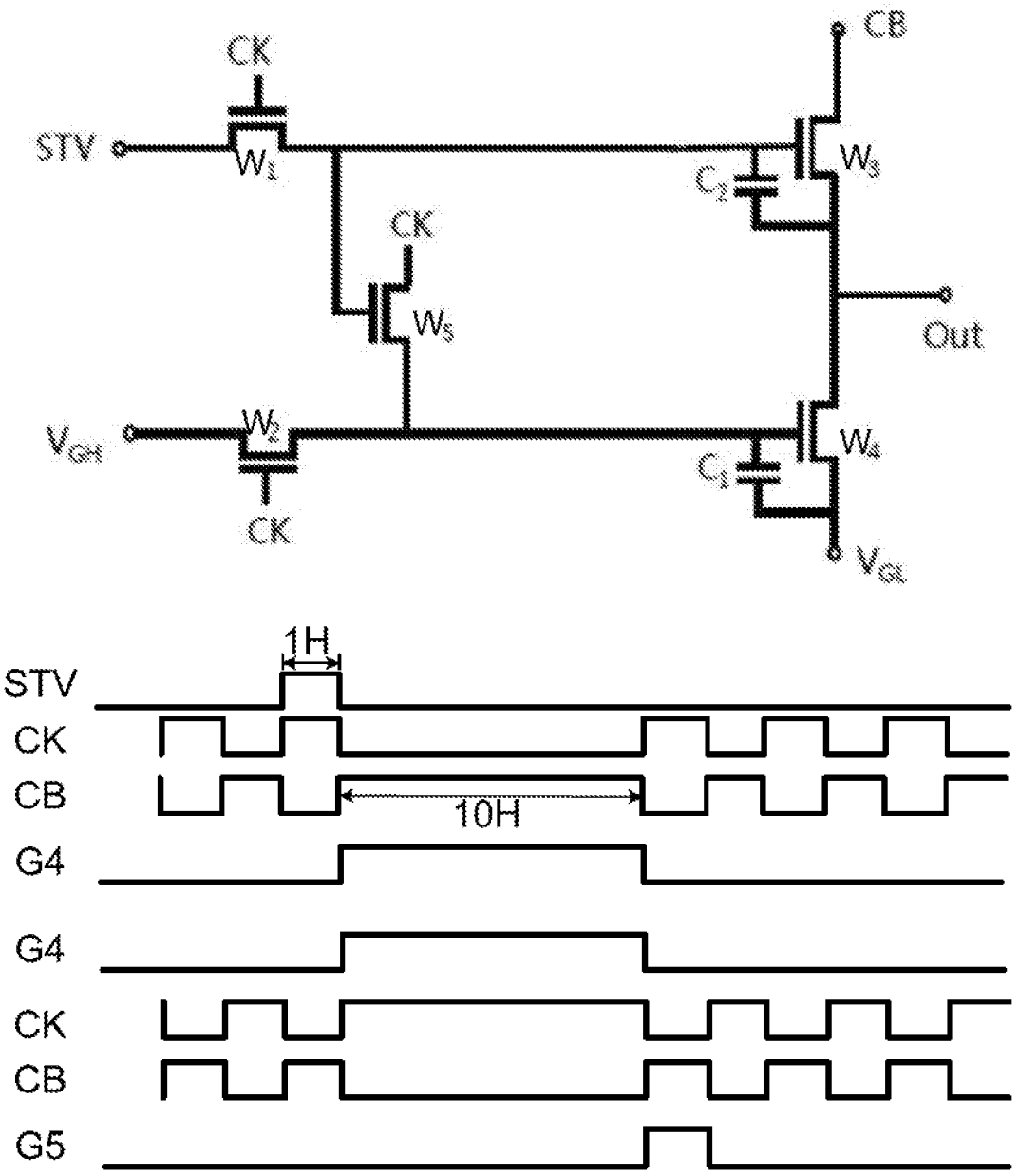
FIG. 6 is an exemplary gate-driver-on-array driving circuit and corresponding gate-driving signals having extended scan time for at least one scan line according to an embodiment of the present disclosure.

FIG. 6 shows an exemplary gate-driver-on-array driving circuit and corresponding gate-driving signals having extended scan time for at least one scan line according to an embodiment of the present disclosure. Referring to FIG. 6, the gate-driver-on-array circuit includes a shift-register unit having a 5T2C structure (with fiver transistors $W_1$~$W_5$, and two capacitors $C_1$ and $C_2$) under controlled by shift clock signals CK and CB, a start voltage STV (for driving a gate-driving signal output from the Out terminal to a first scan line), a low voltage supply $V_{GL}$, and a high voltage supply $V_{GH}$. The outputted signal in the first scan line also is used as an input signal (replacing STV in a next 5T2C shift-register unit) for driving a gate-driving signal output from the respective Out terminal to a second scan line. When the shift clock signals CK and CB has one pulse width with extended width, the Out terminal also outputs a gate-driving signal (e.g., G4) with a pulse width changing with the changing pulse width of the clock signals CK and CB. In the embodiment, the controller can be used to intentionally extend the pulse width of the HCLK signal outputted from the GOA circuit connected to the scan line of the m-th row that is selected for sensing, for example, from one unit scan time H to K×H, K being a number up to a few tens. Then, the scan signal $G_m$ is also provided with effectively extended pulse width corresponding to the extended scan time long enough for sensing the charged voltage in the sensing line (see FIG. 4). Optionally according to an operation scheme in the present invention, in one cycle, only one row of pixels is selected for sensing so that the sensing time can be set sufficiently long for properly establishing $V_{th}$ via charging the source electrode of the driving transistor by providing the scan signal $G_m$ with a corresponding extended pulse width.

Referring to FIG. 5 again, in the first frame, the first row of pixels is selected for sensing $V_{th}$ of the driving transistor of the pixel therein. Thus, the first scan line associated with the first row of pixels receives the scan signal $G_{m=1}$ with an extended pulse width. Within the time of the extended pulse width, it includes a resetting sub-period, a $V_{th}$ establishing sub-period, a $V_{th}$ sampling sub-period, and a data-input and compensation period for loading the first data $V_{data'}$ that is compensated in luminance based on the sensed $V_{th}$ for the pixel in the first row. The pixels in the first row will start to emit light after the first data $V_{data'}$ is loaded. At the same time, the sensed $V_{th}$ is read and saved via the driver IC into a memory of the compensation module. Starting from the second row till the last (M-th) row, each scan is performed as a normal scan by receiving a scan signal $G_m$ with a normal pulse width of one unit scan time H to write data via the signal line served as a data line. During the time of the normal scan for any one row from the second row to the M-th row, each pixel is loaded with a correspondingly compensated data signal $V_{data'}$ using a sensed $V_{th}$ obtained in one of previous M−1 numbers of cycles when the one row was just selected for sensing. For example, when the $2^{nd}$ row is scanned in the current cycle, the pixel thereof is loaded with a data signal compensated using a corresponding $V_{th}$ for the same pixel stored in the memory when the $2^{nd}$ row was sensed in a previous cycle in M−1 numbers of cycles earlier than the current cycle. Similarly, when the $3^{rd}$ row is scanned in the current cycle, the pixel thereof is loaded with a data signal compensated using a corresponding $V_{th}$ for the same pixel stored in the memory when the $3^{rd}$ row was sensed in a previous cycle in M−2 numbers of cycles earlier than the current cycle. When the last M-th row is scanned, in the current cycle, the pixel thereof is loaded with a data signal compensated using a corresponding $V_{th}$ for the same pixel stored in the memory when the M-th row was sensed in a previous cycle that is just one cycle before the current cycle. Each pixel in each of the second row to M-th row will emit light based on the compensated data signal $V_{data'}$ after it is loaded till the end of the first cycle under control of the scan signal $G_1$ in low voltage (turn-on voltage for PMOS transistor) to turn the switch transistor T2 on. Only for the pixel in the first row, it has shorter time to emit light as it spends more time for sensing the $V_{th}$. Accordingly, the $V_{data'}$ loaded for the pixel in first row needs to take extra compensation to cover the loss of emission time.

Optionally, in the current cycle, when the first row of pixels, which is selected for sensing the $V_{th}$ thereof, finishes the sensing operation to save the sensed $V_{th}$ in the memory, it follows a data-input and compensation operation to load a correspondingly compensated data signal $V_{data'}$ using not the just sensed $V_{th}$ but one saved $V_{th}$ in a previous cycle (e.g., one done in M-th cycle earlier). Optionally, the just sensed $V_{th}$ in the current cycle may not be saved into the memory until the previously saved $V_{th}$ is firstly loaded from the memory. By all means, the data compensation is not performed in real time.

Optionally, when each row of pixels is scanned for the first time after the display panel is powered on, the first compensated data being loaded for generating drive current for the LED is based on a factory-stored $V_{th}$. Each sensed $V_{th}$ during the first M cycles of displaying time is not used to generate compensated data in real time until the (M+1)-th cycle starts and progressively proceeds.

In the second frame, the second row of pixels is selected for sensing $V_{th}$ of the driving transistor of the pixel therein. Firstly, for each pixel in the first row of pixels a respective compensated data signal is loaded with a data-input and compensation period in a normal scan of one unit scan time. Then, the pixels in the first row of pixels are driven to emit light based on at least the loaded compensation data signal. When the second scan line is scanned with a scan signal $G_{m=2}$, the corresponding signal line associated with the pixel in the second row of pixels is served as a sensing line for executing a sensing operation to detect a sensing signal during an extended scan time. In particular, the sensing operation includes a resetting sub-period, a $V_{th}$ establishing sub-period, a $V_{th}$ sampling sub-period, and data-input and compensation period to write a compensated data signal back to the signal line. The $V_{th}$ of the driving transistor of the pixel in the second row is deduced from the sensing signal by the external compensation module and stored in a memory device within the controller. After the sensing operation, the externally compensated data signal $V_{data'}$ is re-written back to the pixel in the second row of pixels, driving the pixels in the second row to emit light. Note, since the sensing period for this scan takes more time than a normal scan (such as the scan of the first row), it also results in less time for emission. The compensated data signal $V_{data'}$ therefore includes an extra compensation to cover the loss of mission time due to the added sensing period before the data-input and compensation period. Starting from the third row till the last M-th row, each scan is performed by receiving a scan signal $G_m$ with normal pulse width of one unit scan time.

Similarly, in the third flame, only the third row of pixels is selected for sensing the $V_{th}$. The operation of the display panel is still conducted by scanning progessively one row after another, first two rows are scanned with two normal scans, and the third row is scanned with a sensing scan having an extended scan time. Starting from the fourth row to M-th row, each row is scanned with a normal scan. This operation scheme is repeating until the $V_{th}$ in every pixel of all M numbers of rows of pixels is sensed once through total M numbers of cycles. Then, in a next (M+1)-th cycle, the first row of pixels is selected for sensing again. For example, in a HID display panel with refreshing rate of 60 Hz, the $V_{th}$ in all pixels being sensed once takes about 18 seconds if only one row of pixels is selected for sensing in one cycle.

Figure 7:
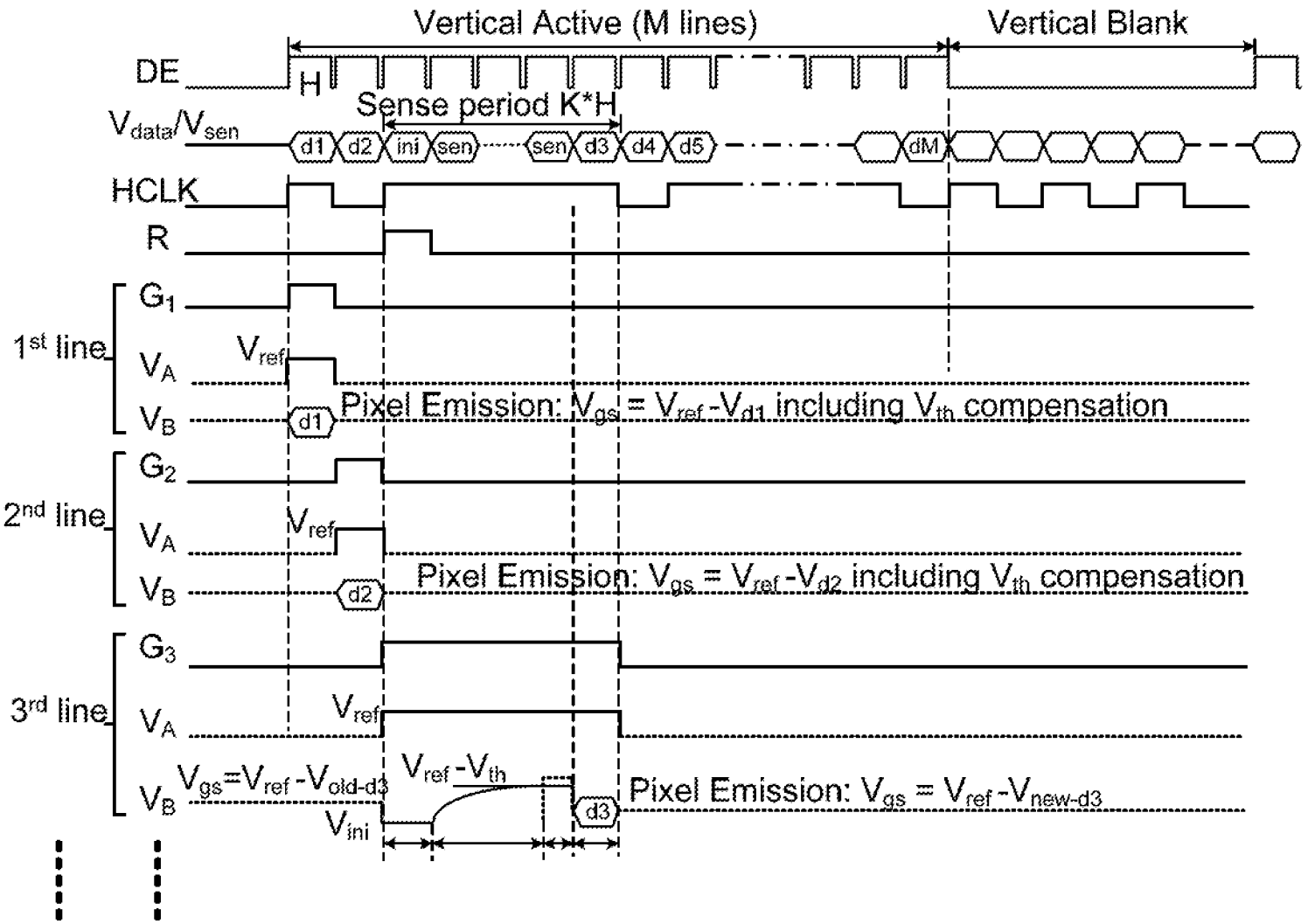
FIG. 7 is a schematic liming diagram showing one frame of a M-row active pixel matrix of a display panel being scanned with the third row being selected as a sensing row according to an embodiment of the present disclosure.

FIG. 7 is a schematic timing diagram showing one frame of a M-row active pixel matrix of a display panel being scanned with the third row being selected as a sensing row according to an embodiment of the present disclosure. In another example, FIG. 7 shows a cycle of driving a display panel with total M numbers of rows of pixels in which the third row of pixels is selected as a sensing row to detect the electrical parameters of respective pixels. The display panel includes M numbers of scan lines. Each scan line is connected to one row of pixels. Normally, each scan performed for each row takes one unit scan time H for a data signal to be loaded to each pixel in the row. The one unit scan time H is enabled by a digital enabling signal DE generated by a controller associated with the display panel. When the row being scanned is a sensing row, it is scanned with an extended scan time which is intentionally set to be much longer than a normal scan time. Optionally, the extended scan time is set to be K times of the one unit scan time H. For example, K=20. As the sensing row is scanned, it goes through the following sub-periods in this 20 H scan time, including a resetting sub-period of 1 H at a start, a $V_{th}$ establishing sub-period of 13 H, a $V_{th}$ sampling sub-period of 5 H, and a data-input and compensation period of 1 H at an end. The data-input and compensation period of 1 H within the extended scan time of 20 H for writing a compensated data signal $V_{data'}$ to the pixel of the sensing row is substantially the same as the data-input and compensation period for writing another compensated data signal $V_{data'}$ back to the pixel of a non-sensing row in a normal scan. Totally for scanning through one frame of whole M rows of pixels in the display panel, it needs at least (M+19)×H effective scan time including M×H active time (V-active) plus at least 19 H blank time (V-blank). The V-active time is when pixels are actively driven to emit light while V-blank time is when no pixel is driven to emit light. In general, vertical blank time between two neighboring cycles could be longer for other purposes, but at least if one cycle needs nH scan time for sensing the $V_{th}$ in one sensing row the input data signals need to be set with (n−1)H vertical blank time.

Referring to FIG. 7, the first row and the second row have been respectively used as sensing row in previous two cycles so that the $V_{th}$ values for two respective pixels in the first row and the second row sensed in the corresponding previous two cycles can be stored separately in memory associated with the external compensation module in the controller. In the current cycle, when the first row and the second row are respectively scanned, the signal lines of the respective pixel circuits are configured to receive data $V_{data'}=V_{data}-V_{th}$ from the compensation module that have been compensated using the $V_{th}$ sensed in respective previous two cycles and to write the $V_{data'}$ into the respective pixels in the first row and the second row. Here, $V_{data}$ is original image data. $V_{data}$ for the pixel in the first row is $V_{d1}$. $V_{data}$ for the pixel in the second row is $V_{d2}$. The two scans are just two normal scans. Each normal scan is driven by the clock signal HCLK with a pulse width of one unit scan time H generated by the controller. Based on the clock signal HCLK, a gate-driver-on-array shift-register unit associated with the first row outputs a first scan signal G1 during the unit scan time H for scanning the first row and a gate-driver-on-array shift-register unit associated with the second row outputs a second scan signal G2 during the unit scan time H for scanning the second row after scanning the first row.

As the pulse of the first scan signal G1 ends, the storage capacitor Cst coupled between the gate and source electrodes of the driving transistor T1 in the pixel circuit associated with the pixel in the first row stores a voltage $V_{gs}=V_{ref}+V_{th}-V_{data}$. A drive current $I_D$ flowing through the driving transistor T1 thus can be expressed as:

$$I_D=\tfrac{1}{2}\mu C_{OX}W/L(V_{gs}-V_{th})^2=\tfrac{1}{2}\mu C_{OX}W/L(V_{ref}-V_{data})^2$$

This drive current $I_D$ is guided to a light-emitting diode when the first scan signal G1 turns to a low voltage to turn on the switch transistor T2. The pixel in the first row then emit light from the light-emitting diode based on the drive cumin $I_D$ above which is substantially compensated the effect of the threshold voltage $V_{th}$.

In the current cycle, the third row is selected to be the sensing row. When the third row is scanned, the HCLK signal is provided with an extended pulse width of K×H, K being a number up to a few tens. Accordingly the scan signal G3 outputted from a corresponding gate-driver-on-array shift-register circuit is also provided with the pulse width of K×H corresponding to the extended scan time for this sensing row. During this extended scan time, it first includes a resetting sub-period to provide a reset signal R for controlling a voltage initialization via the signal line to the pixel circuit to allow the voltage in the signal line is lower than $V_{ref}-V_{th}$. One unit scan time H is enough for the resetting sub-period. Secondly, in a next $V_{th}$ establishing sub-period, the source electrode of the driving transistor is charged from the level initialized during the resetting sub-period to a level depended by the threshold voltage $V_{th}$ of the driving transistor and the reference voltage $V_{ref}$ set to the gate electrode of the driving transistor. The source electrode voltage ultimately is stored into a parasitic capacitor of the signal line which is now served as a sensing line. Immediately after the $V_{th}$ establishing sub-period a sampling sub-period allows a driver IC to read a sensing signal carrying the voltage stored in the sensing line and pass it to the external compensation module. In order to allow the charging effect to be sufficient into the source electrode and into the sensing line, the time needed for these last two sub-periods is at least more than 10 H up to several tens of H. The external compensation module is able to calculate a compensation signal, which is the threshold voltage $V_{th}$ of the driving transistor associated with the pixel in the third row, based on the sensing signal. Then, the calculated $V_{th}$ is stored in memory of the external compensation module. Additionally, the external compensation module is able to calculate a compensated data signal $V_{new_d3}$ that is compensated from the incoming original data signal $V_{old_d3}$ using the $V_{th}$ stored therein.

In the last portion of the extended scan time of the third row, the signal line is served again as a data line. The compensated data signal $V_{new_d3}=V_{old_d3}-V_{th}$ is written via the data line to the pixel, based on which the pixel of the third row emits light after the scan signal G3 is changed from the high voltage pulse to a low voltage level through the remaining time of the current cycle until next high voltage pulse comes in next cycle. Since the time of light emission of the pixel in the third row is less than that of other pixel in one of $1^{st}$, $2^{nd}$, $4^{th}$~M-th rows of the display panel due to usage of extra time of 19 H for sensing, the compensation data signal mentioned above for the third row needs extra compensation to increase it by a factor of 19/M. In general, for the sensing row the data written back to the signal line of the pixel circuit immediately after sensing the $V_{th}$ at the same signal line should be compensated with an extra factor of (K−1)/M·100%, assuming that the extended scan time for the sensing row is given as K units scan time (H). Additionally, since scanning the sensing row increases scan time by (K−1)H, in the timing scheme for the data signal input, the vertical blank time between two cycles should be set at least greater than the increased time of (K−1)H.

Figure 8:
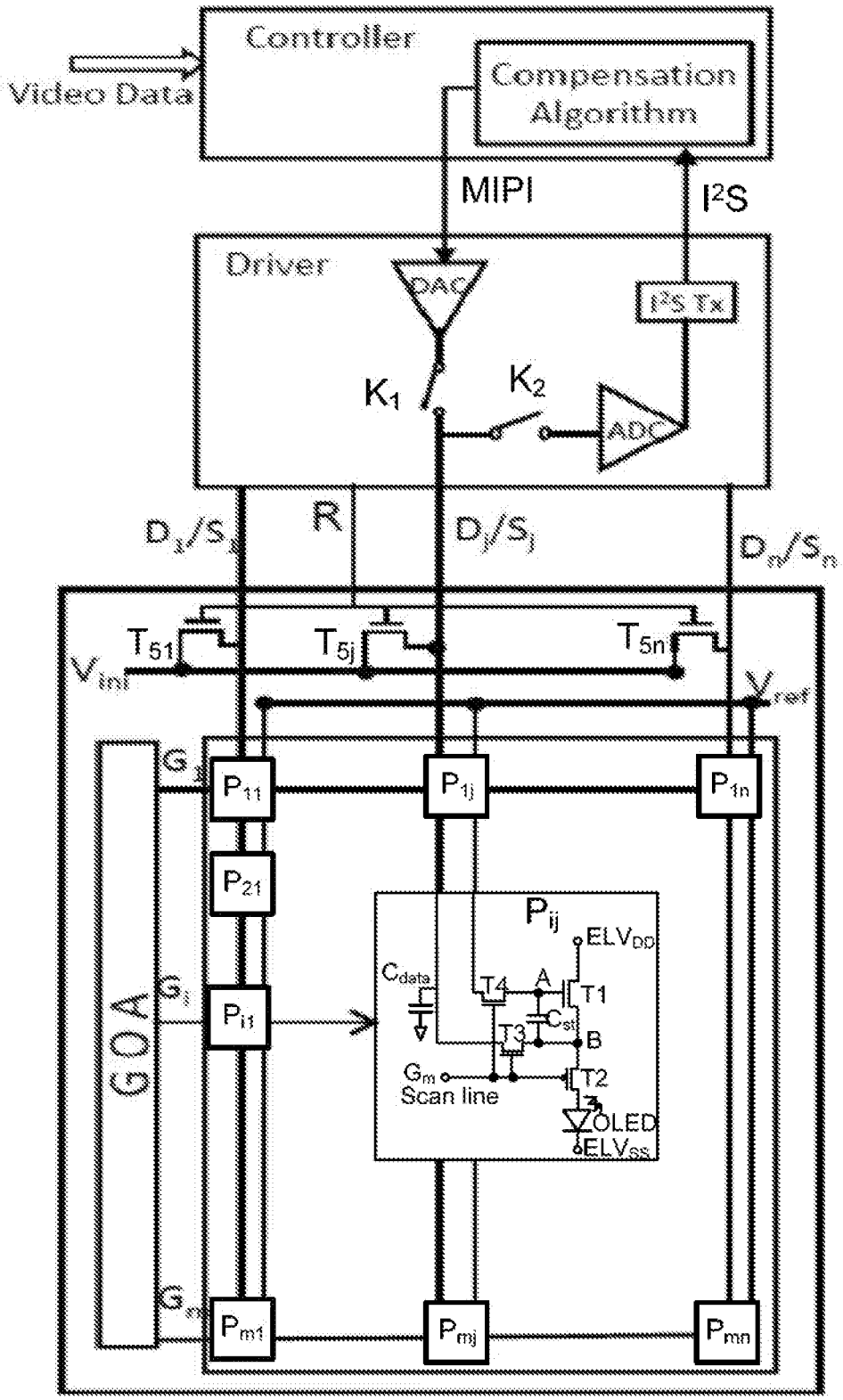
FIG. 8 is a schematic diagram of a display apparatus including the pixel circuit of FIG. 1 for each pixel having a time-shared signal line according to an embodiment of the present disclosure.

In another aspect, the present disclosure provides a display apparatus. FIG. 8 is a schematic: diagram of a display apparatus including the pixel circuit of FIG. 1 for each pixel having a time-shared signal line according to an embodiment of the present disclosure. Referring to FIG. 8, the display apparatus includes a display panel having an M-row active pixel matrix. The pixel circuit described herein (FIG. 1) is disposed in each pixel $P_{ij}$ (in i-th row and j-th column including the light-emitting diode (OLED). The pixel circuit is coupled to a bias circuit $T_{5j}$ via the time-shared signal line $D_j/S_j$. A driver IC is connected to the pixel circuit via the signal line $D_j/S_j$. Additionally, the display apparatus includes a controller including a compensation module communicated with the driver IC via an interface. When one row of the M-row active pixel matrix is scanned with extra sensing period in an extended scan time once in one cycle of displaying a frame of image, the time-shared signal line $D_j/S_j$ is served as a sensing line to read a sensing signal carrying local electrical parameters to the compensation module in the controller. Alternatively, when the one row is scanned in a normal scan time during the cycle, the signal line is served as a data line to load a data signal (video data) compensated by the compensation module based on the local electrical parameters back to the pixel $P_{ij}$ for determining a drive current to drive the light-emitting diode OLED to emit light.

Optionally, each row of pixels in the M-row active pixel matrix is associated with at least a scan hue for supplying a scan signal having a pulse width of one unit scan time H for a normal scan or an extended pulse width of K units scan time for a sensing scan. K is a number up to a few tens, giving the extra sensing period of (K−1)H.

Optionally, the M-row active pixel matrix is scanned progressively one row after another in each cycle of displaying one frame of image. In particular, one sensing scan is performed far just one row selected for sensing and one normal scan for every one row out of remaining M−1 rows of the M-row active pixel matrix. A blanking time having at least (K−1) units scan time is provided from one cycle to a next cycle.

Optionally, the light-emitting diode associated with each pixel is an organic light-emitting diode (OLED). The display panel is an OLED display panel that has a reduced frame width by laying the time-shared signal line for each pixel circuit therein.

The foregoing description of the embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A pixel circuit for one pixel in a M-row active pixel matrix of a display panel comprising:

a driving sub-circuit respectively coupled to a first power supply, a first node, a second node, and configured to drive a light-emitting device of a pixel in an m-th row of pixels of the M-row active pixel matrix, 1≤m≤M; and a data-inputting and sensing sub-circuit respectively coupled to the first node, the second node, a reference voltage terminal, a scan line associated with the pixel in the m-th row of pixels, a signal line, and the light-emitting device associated with the pixel; wherein the data-inputting and sensing sub-circuit is configured, when the m-th row of pixels is a selected row for sensing in a current cycle of displaying one frame of image, to use the signal line as a sensing line in a sensing period for detecting a sensing signal to generate a compensation signal for the pixel and to use the signal line as a data line in a data-input and compensation period for loading a data signal compensated based on the compensation signal for the pixel;

wherein the data-inputting and sensing sub-circuit is further configured, when the m-th row of pixels is other than the selected row for sensing in the current cycle, to use the signal line as a data line in a data-input and compensation period for loading a data signal compensated based on a compensation signal generated for the pixel in the m-th row of pixels in an earlier cycle in which the m-th row of pixel was the selected row wherein the driving sub-circuit comprises a driving transistor having a drain electrode coupled to the first power supply, a gate electrode coupled to the first node, and a source electrode coupled to the second node;

wherein the data-inputting and sensing sub-circuit comprises:

a second transistor having a source electrode coupled to the second node, a gate electrode coupled to the scan line, and a drain electrode coupled to an anode of the light-emitting device which has a cathode coupled to a second power supply;

a third transistor having a drain electrode coupled to the signal line, a gate electrode coupled to the scan line, and a source electrode coupled to the second node;

a fourth transistor having a drain electrode coupled to the reference voltage terminal, a gate electrode coupled to the scan line, and a source electrode coupled to the first node; and a storage capacitor having a first electrode coupled to the first node and a second electrode coupled to the second node;

wherein the first power supply provides a fixed high voltage, the second power supply provides a fixed low voltage, the second transistor is a p-type transistor, each of the driving transistor, the third transistor, and the fourth transistor is an n-type transistor; the light-emitting device is an organic light-emitting diode;

wherein each cycle comprises M−1 numbers of normal scans and one sensing scan, wherein each of the M−1 numbers of normal scans corresponds to applying an effective gate-driving signal to the scan line associated with the m-th row of pixel out of M−1 numbers of rows other than the selected row for sensing to load the data signal to the signal line served as the data line during the data-input and compensation period and further to the source electrode of the driving transistor, and to set a reference voltage from the reference voltage terminal to the gate electrode of the driving transistor, thereby determining a drive current to drive light emission of the light-emitting device of the pixel of the m-th row of pixels in remaining time of the current cycle, wherein the data signal is compensated from an original data voltage provided for the pixel in the current cycle by subtracting a threshold voltage of the driving transistor carried in the sensing signal detected in one of earlier M−1 numbers of cycles.

2. The pixel circuit of claim 1, wherein the one sensing scan corresponds to the sensing period added before the data-input and compensation period for the m-th row of pixels being selected for sensing in the current cycle, wherein the sensing period includes a resetting sub-period, an establishing sub-period, and a sampling sub-period, wherein the one sensing scan is K times longer than each normal scan, wherein K is a number up to a few tens.

3. The pixel circuit of claim 2, further is coupled to a bias circuit comprising a fifth transistor having a drain electrode coupled to an initializing voltage terminal, a gate electrode coupled to a reset terminal, and a source electrode coupled to the signal line, wherein the reset terminal provides an effective reset signal in the resetting sub-period to set an initializing voltage from the initializing voltage terminal to a parasitic capacitor associated with the signal line and to the source electrode of the driving transistor via the second node, wherein the initializing voltage is set to be smaller than a first voltage equal to the reference voltage minus a threshold voltage of the driving transistor.

4. The pixel circuit of claim 3, wherein the source electrode of the driving transistor is gradually charged to the first voltage in the establishing sub-period which is made long enough in the one sensing scan to allow the first voltage to be fully stored in the parasitic capacitor of the signal line.

5. The pixel circuit of claim 4, wherein the signal line is served as the sensing line from which the first voltage stored in the parasitic capacitor of the signal line is read as the sensing signal in the sampling sub-period and sent to an external compensation circuit for deducing the threshold voltage of the driving transistor as the compensation signal and generating a compensated data signal for the pixel, the compensated data signal being a difference between the original data voltage and the threshold voltage.

6. The pixel circuit of claim 5, wherein the signal line is served as the data line to send the compensated data signal for the pixel back to the data line in the data-input and compensation period following the sensing period and to store a second voltage in the storage capacitor, the second voltage being the reference voltage minus the compensated data signal for generating a drive current to drive light emission of the light-emitting device of the pixel beyond the data-input and compensation period in remaining time of the current cycle.

7. The pixel circuit of claim 5, wherein the compensated data signal for the pixel in the selected row for sensing is further compensated with an extra compensation signal increased by a (K−1)/M·100% for a loss of light emission during the sensing period before being loaded to the data line in the data-input and compensation period following the sensing period in one sensing scan in the current cycle; and the compensated data signal for the pixel in any one row other than the selected row for sensing is configured to be loaded to the data line without the extra compensation signal in the data-input and compensation period in one normal scan without the sensing period in each of next M−1 numbers of cycles.

8. The pixel circuit of claim 2, wherein the one sensing scan is associated with one row selected from the M-row active pixel matrix per cycle, which is rotated from a first row (m=1) in a first cycle to a last row (m=M) in M-th cycle in M numbers of cycles.

9. A display apparatus comprising a display panel having M-row active pixel matrix, a pixel circuit disposed in a respective pixel of the M-row active pixel matrix, a bias circuit coupled to a signal line associated with the pixel circuit, a driver IC connected to the pixel circuit via the signal line, and a control circuit including a compensation circuit coupled to the driver IC via a communication interface;

wherein the pixel circuit comprises:

a driving sub-circuit respectively coupled to a first power supply, a first node, a second node, and configured to drive a light-emitting device of a pixel in an m-th row of pixels of the M-row active pixel matrix, 1≤m≤M; and a data-inputting and sensing sub-circuit respectively coupled to the first node, the second node, a reference voltage terminal, a scan line associated with the pixel in the m-th row of pixels, a signal line, and the light-emitting device associated with the pixel; wherein the data-inputting and sensing sub-circuit is configured, when the m-th row of pixels is a selected row for sensing in a current cycle of displaying one frame of image, to use the signal line as a sensing line in a sensing period for detecting a sensing signal to generate a compensation signal for the pixel and to use the signal line as a data line in a data-input and compensation period for loading a data signal compensated based on the compensation signal for the pixel;

wherein the signal line in a sensing scan of a current cycle of displaying one frame of image is served as a sensing line used to detect local electrical parameters of the pixel and send a sensing signal carrying the local electrical parameters to a compensation circuit in the control circuit and alternatively served as a data line used to load a data signal compensated by the compensation circuit based on the local electrical parameters back to the pixel;

wherein each row of pixels in the M-row active pixel matrix is associated with at least a scan line for supplying a scan signal having a pulse width of one unit scan time for a normal scan or an extended pulse width of K units scan time for the sensing scan, wherein K is a number up to a few tens;

wherein the M-row active pixel matrix is scanned progressively one row after another in each cycle of displaying one frame of image, wherein the sensing scan is performed for just one row of pixels selected for sensing and the normal scan is performed for every one row out of remaining M−1 numbers of rows other than the selected row for sensing in the M-row active pixel matrix, wherein a blanking time having at least (K−1) units scan time is provided from one cycle to a next cycle.

10. The display apparatus of claim 9, wherein the one row selected for sensing is selected once per cycle by rotating among M numbers of rows of the M-row active pixel matrix sequentially in M numbers of cycles.

11. A method for driving a display panel with a M-row active pixel matrix in one cycle of displaying one frame of image, the method comprising:

scanning a control signal to one row after another of M rows of pixels in the M-row active pixel matrix to set a reference voltage to a gate voltage of a driving transistor in a pixel circuit associated with a pixel in an m-th row, $1 \leq m \leq M$;

using a signal line connected to the pixel circuit as a sensing line if the m-th row is selected to be a sensing row in a current cycle;

reading a sensing signal from the sensing line for determining a compensated data signal in a sensing period in an extended scan time in the current cycle;

making the signal line as a data line in a data-input and compensation period following the sensing period;

loading the compensated data signal via the data line in the data-input and compensation period to set a source voltage of the driving transistor in the pixel associated with the pixel in the sensing row; and loading a data signal via the signal line served as the data line to set a source voltage of the driving transistor in the pixel circuit if the m-th row belongs to other M−1 numbers of rows other than the sensing row in a data-inputting period in a normal scan time without a sensing period in the current cycle, the data signal being compensated based on another sensing signal read in one of earlier M−1 numbers of cycles;

wherein the normal scan time comprises one unit of time and the extended scan time comprises K times of the unit of time, wherein K is up to a few tens;

wherein reading the sensing signal comprises resetting the sensing line to an initializing voltage firstly in a resetting sub-period of the sensing period, the initializing voltage being set to be smaller than a first voltage equal to the reference voltage minus a threshold voltage of the driving transistor;

charging the sensing line to reach the first voltage in an establishing sub-period of the sensing period by making K sufficiently large in the extended scan time; and sending the first voltage to an external compensation circuit in a sampling sub-period of the sensing period for generating the compensation data signal equal to an original data signal minus the threshold voltage of the driving transistor.

12. The method of claim 11, wherein loading the compensated data signal comprises sending the compensated data signal with an extra compensation to cover a loss of emission time during the sensing period beyond a compensation of the threshold voltage of the driving transistor from the external compensation circuit to the pixel circuit associated with the pixel in the one row selected as the sensing row in current one cycle; and sending the compensated data signal with the compensation of the threshold voltage of the driving transistor from the external compensation circuit to the data line of the pixel circuit to set the source voltage of the driving transistor in the pixel circuit associated with a same pixel in a same m-th row but other than the sensing row in each one of next M−1 numbers of cycles.

* * * * *